US006598862B2

(12) United States Patent
Merrill et al.

(10) Patent No.: US 6,598,862 B2
(45) Date of Patent: Jul. 29, 2003

(54) EVAPORATIVE COOLER

(75) Inventors: Richard P. Merrill, Columbia, MD (US); George R. Shriver, Sykesville, MD (US)

(73) Assignee: Evapco International, Inc., Wilmington, DE (US)

( * ) Notice: Subject to any disclaimer, the term of this patent is extended or adjusted under 35 U.S.C. 154(b) by 0 days.

(21) Appl. No.: 09/885,386

(22) Filed: Jun. 20, 2001

(65) Prior Publication Data

US 2002/0195729 A1 Dec. 26, 2002

(51) Int. Cl.[7] ..... B01F 3/04

(52) U.S. Cl. ..... 261/128; 261/36.1; 261/151; 261/152; 261/155; 261/DIG. 11

(58) Field of Search ..... 261/95, 103, 97, 261/108, 127, 128, 151, 152, 155, 156, 36.1, DIG. 3, DIG. 43, DIG. 11

(56) References Cited

U.S. PATENT DOCUMENTS

| | | | | |
|---|---|---|---|---|
| 2,626,129 A | * | 1/1953 | Obert | 261/152 |
| 3,012,416 A | | 12/1961 | Dart et al. | |
| 3,141,308 A | | 7/1964 | Dart | |
| 3,169,575 A | | 2/1965 | Engalitcheff, Jr. et al. | |
| 3,747,362 A | | 7/1973 | Mercer | |
| 3,864,442 A | * | 2/1975 | Percy | 261/152 |
| 4,112,027 A | | 9/1978 | Cates | |
| 4,683,101 A | | 7/1987 | Cates | |
| 4,755,331 A | | 7/1988 | Merrill et al. | |
| 5,124,087 A | | 6/1992 | Bradley et al. | |
| 5,435,382 A | | 7/1995 | Carter | |
| 5,724,828 A | | 3/1998 | Korenic | |
| 5,816,318 A | | 10/1998 | Carter | |

FOREIGN PATENT DOCUMENTS

| | | | | |
|---|---|---|---|---|
| JP | 52-37249 | * | 3/1977 | 261/151 |

OTHER PUBLICATIONS

Publication 2000 Ashrae Handbook, HVAC Systems and Equipment—pp. 36.6–36.7.

* cited by examiner

*Primary Examiner*—C. Scott Bushey
(74) *Attorney, Agent, or Firm*—Sonnenschein Nath & Rosenthal

(57) ABSTRACT

An evaporative cooler and method of operation is provided in which the cooler includes a liquid distributor, a body having a surface for receiving liquid from the distributor, an air moving device for generating a flow of air over the surface of the body, a heat transfer working fluid conduit having a surface arranged to receive substantially all of the liquid from the body and a liquid recirculating mechanism to recirculate the liquid from the conduit surface to the body surface. In an embodiment the body occupies a plan area larger than the plan area occupied by the conduit. In an embodiment, the conduit is located outside of the flow of air. In an embodiment, the velocity of the liquid is increased after it leaves the body and before it engages the conduit.

52 Claims, 6 Drawing Sheets

EVAPORATIVE COOLER

BACKGROUND OF THE INVENTION

The present invention generally relates to evaporative coolers and more specifically to a heat exchange apparatus such as a closed-loop cooling tower or an evaporative condenser.

Evaporative coolers are commonly employed which include indirect and direct heat exchange sections. An evaporative liquid, generally water, is distributed across an indirect heat exchange section. The indirect heat exchange section is typically comprised of a series of individual, enclosed circuits or loops for conducting a fluid stream which is to be heat treated, that is, to be cooled. When the evaporative cooler is used as a closed-loop cooling tower or evaporative condenser, heat is indirectly transferred from the fluid stream to sensibly heat the surrounding film of evaporative liquid flowing over the enclosed circuits thereby warming the evaporative liquid. Oftentimes these enclosed circuits are a series of tubes or assembly of coils which may be circular in cross section or which may have non-circular cross sections, such as those disclosed in U.S. Pat. No. 4,755,331, the disclosure of which is incorporated herein by reference.

Heat absorbed by the evaporative liquid is directly transferred to an air stream in a direct evaporative heat exchange section. In the direct evaporative heat exchange section the evaporative liquid is directed onto a solid surface area, commonly referred to as wet deck fill and a small portion of the liquid evaporates, thereby cooling the remaining portion. This fill may comprise a variety of constructions such as wooden slats, corrugated metal sheets, stacks of formed plastic sheets, etc. For example, a certain type of fill is disclosed in U.S. Pat. No. 5,124,087, the disclosure of which is incorporated herein by reference.

Over the past 50 years, improvements in the technology of wet deck fill have been tremendous. Wet deck fill has evolved into highly efficient sheets of multifaceted plastic that is much more efficient than the old splash fill, capable of low pressure drops and allows the temperature of the evaporative liquid leaving the fill to approach wet bulb temperatures.

In the earlier days of cooling tower wet deck fill development, the best technology was simply stacked wooden slats that caused the water to splash and turbulate the air flowing through. The object of wet deck fill is to expose as much of the water surface area as possible to as much air flow as possible for as long a time period as possible with a minimal resistance to air flow. The early cooling tower wet deck fills were very inefficient in this process. At that time it was common practice to place a heat transfer coil in the air and water stream without the use of any cooling tower wet deck fill. Wet deck fill had very little advantage over the geometry of tubes in the air stream with water splashing over it.

The invention of improved wet deck fills has caused more and more inventions that use combinations of fill and coil to do this type of cooling. As fill performance improved, inventors discovered the benefit of combining the two media. However, the prior art has emphasized the importance of air flow over (and through) the coil assembly which is coupled with the wet deck fill. In every case, this art still shows the coil with air flowing through it. The inventive efforts over the years have all been directed towards methods of easing or improving the flow of air through the heat transfer coil. Even with these improvements in coil design, the coils were limited in the amount of water that could be sprayed over the coil without choking off the flow of air. In some instances the flow of air had to be arranged in parallel with the flow of water to allow for the desired flow of air through the coil.

Typical evaporative coolers have included the coil of the indirect heat exchanger as part of the fill, either interspersed within the fill in the direct heat exchange section as disclosed in U.S. Pat. No. 3,012,416, or in separate sections, with both the direct and indirect sections relying, at least in part, on significant air flow therethrough for evaporative direct heat exchange to occur in both sections, such as disclosed in U.S. Pat. Nos. 5,435,382; 4,683,101; 5,724,828 and 4,112,027.

The evaporative liquid is typically recirculated through the evaporative cooler such that it passes from the indirect cooling section to the direct cooling section and back to the indirect cooling section in a continuous cycle with makeup liquid added to compensate for the liquid which has evaporated.

SUMMARY OF THE INVENTION

The present invention recognizes the advantages of developments in the art and combines those advantages in unique ways to achieve surprising and unexpected results.

Although all of the prior art teaches the logical idea that putting airflow through the coil will aid in the cooling process, Applicants have determined the surprising result that putting additional airflow through the coil only serves to decrease the performance of the wet deck fill and burden the air moving system with additional flow requirements, costing extra air moving horsepower. While it is not critical for Applicant's invention that there be no air flow at all over the heat transfer coil, Applicants have discovered that the overall performance of the evaporative cooler is enhanced if the air flow over the heat transfer coil is minimized or avoided altogether.

By the present invention, the Applicants have maximized the efficiency of the wet deck fill by distributing the water to be cooled over a relatively larger plan area of a fill housing. This maximizes the amount of water surface area in contact with the airflow and minimizes the work required from the air moving device.

Applicants have made the discovery that when liquid is cascaded over the heat transfer coil of the indirect heat exchanger at very high (or concentrated) flow rates it has surprisingly high heat transfer coefficients or U-values.

Applicants have recognized and utilized the advantage of increasing the liquid load on the indirect heat transfer section (by amounts up to 8 to 16 gallons per minute per square foot—22.74 to 45.48 liters per minute per square meter) while avoiding the disadvantage of increasing the liquid load on the wet deck fill, by providing a smaller plan area for the indirect heat transfer section coil than for the fill and concentrating the liquid flow as it moves from the fill to the coil.

In addition they discovered that the U-value can be increased in two ways, by providing a higher liquid load at the heat transfer coil and/or by increasing the velocity of liquid flow onto or through the heat transfer coil section.

The applicants discovered the surprising results that by not burdening the coil with a cooling airstream they were free to highly concentrate the flow over the coil and to position the coil wherever they wanted without regard to the geometry of the airflow. Also, they were able to take advantage of the increased velocity of the falling water to further enhance the heat transfer coefficient of the coil.

In summary, in an embodiment, the applicants have separated and made more efficient, each heat transfer section although every prior inventor had combined the sections to one degree or another in attempts to achieve the most efficient device. The applicants' invention separates the fill from the coil so the fill can be used to it's maximum efficiency and the coil can be used to it's maximum efficiency.

Specifically, in an embodiment, an evaporative cooler embodying the principles of the present invention includes a liquid distributor for distributing an evaporative liquid (sometimes referred to simply as water) onto a gas and liquid contact body (the wet deck fill) having a surface for receiving the liquid and occupying a first plan area for receiving liquid from the liquid distributor over the surface substantially throughout the first plan area. An air moving device is arranged to generate a flow of air and the body surface is arranged in the flow of air, the flow of air causing a small portion of the liquid received by the body to evaporate, thereby cooling the remaining non-evaporated portion of the liquid. A heat transfer working fluid conduit (the heat transfer coil) is positioned substantially outside of the flow of air and has a second plan area dimensioned smaller than the first plan area. The heat transfer coil has a surface arranged to receive substantially all of the cooled liquid from the body. A liquid concentrator is arranged between the body and the heat transfer coil to concentrate the cooled liquid from the first plan area into the second plan area. The cooled liquid, as it falls over the surfaces of the heat transfer coil, is sensibly re-heated as heat is withdrawn from the working fluid circulating inside the conduit, to cool the working fluid. A liquid collector receives substantially all of the falling, heated liquid from the heat transfer working fluid conduit. A liquid recirculating mechanism returns the heated liquid to the liquid distributor for a repeat of the cycle.

In an embodiment of the invention, the evaporative cooler comprises a liquid distributor and a body for receiving liquid from the liquid distributor. An air moving device is arranged to generate a flow of air over the body, the flow of air causing a small portion of the liquid received by the body to evaporate, thereby cooling the remaining non-evaporated portion of the liquid. A heat transfer working fluid conduit is arranged to receive substantially all of the cooled liquid from the body. A flow accelerator is positioned between the body and the heat transfer working fluid conduit to accelerate a flow velocity of the cooled liquid by at least 9.5 feet per second (2.9 meters per second) before contacting a surface of the heat transfer working fluid conduit. The cooled liquid, as it falls over the surfaces of the heat transfer working fluid conduit, is sensibly heated as it cools the working fluid circulating inside the conduit. A liquid collector is positioned to receive substantially all of the heated liquid from the surface of the heat transfer working fluid conduit. A liquid recirculating mechanism is provided to return the heated (or collected) liquid to the liquid distributor.

In an embodiment of the invention, a method is provided of cooling a working fluid comprising the step of dispensing a liquid onto a surface of a body wherein the body occupies a first plan area. The air is flowed over the body to effect an evaporation of a portion of the liquid thereby cooling the remaining portion. The remaining cooled portion of the liquid is dispensed and concentrated onto a surface of a heat transfer working fluid conduit wherein the heat transfer working fluid conduit occupies a second plan area smaller than the first plan area and is maintained in an area substantially free of an air flow. The evaporatively cooled fluid is flowed over and around the heat transfer working fluid conduit to transfer heat between the working fluid and the evaporatively cooled liquid. In this process the evaporatively cooled liquid is heated and the working fluid inside the conduit is cooled. The heated liquid is collected from the exterior surface of the heat transfer working fluid conduit and recirculated onto the body.

An advantage provided by an embodiment of the present invention is that when the coil is spaced below the wet deck fill in a factory built module, the center of gravity of the module is lowered, which improves the transportability of the module. Once such a construction is in place, whether factory built or built on site, the lower center of gravity provides advantages related to seismic loading considerations, steel loading considerations and wind loading considerations.

In embodiments of the present invention which have the coil spaced from the wet deck fill, all six sides of the coil are readily accessible, at ground level, which allows for ease of access for inspection or cleaning of the coil.

In embodiments of the present invention where the coil is substantially or completely outside of the airstream flowing through the cooler, there is less of a chance for scale to form on the coil from the evaporative process. Such scale could otherwise negatively impact on heat transfer through the coil in that it acts as a heat insulator, reducing the heat transfer effectiveness through the coil walls.

Also in embodiments of the present invention where the coil is substantially or completely outside of the airstream flowing through the cooler, the air is protected against contamination from air borne dirt and debris, as well as sunlight passing through louvers or other openings. Also, in some situations, unintentional heat transfer occurs at a conventional airstream exposed coil, which would be avoided in such embodiments where the coil is located substantially or completely outside of the airstream.

DETAILED DESCRIPTION OF THE PREFERRED EMBODIMENTS

The present invention relates to evaporative coolers and can be employed in a wide variety of constructions and arrangements. While several of such arrangements are illustrated herein, there are numerous other embodiments and constructions in which the present invention can be realized. For example, although the preferred embodiment is illustrated herein as a construction which is built in a factory, the present invention could also be realized in a field built evaporative cooler. Factory assembled units are typically constructed in one or two piece modules, where field built equipment may be separate components or units erected in place and arranged not necessarily within a common housing. Other arrangements will be apparent to a person of skill in the art from the following description of the preferred embodiments.

Figure 1:
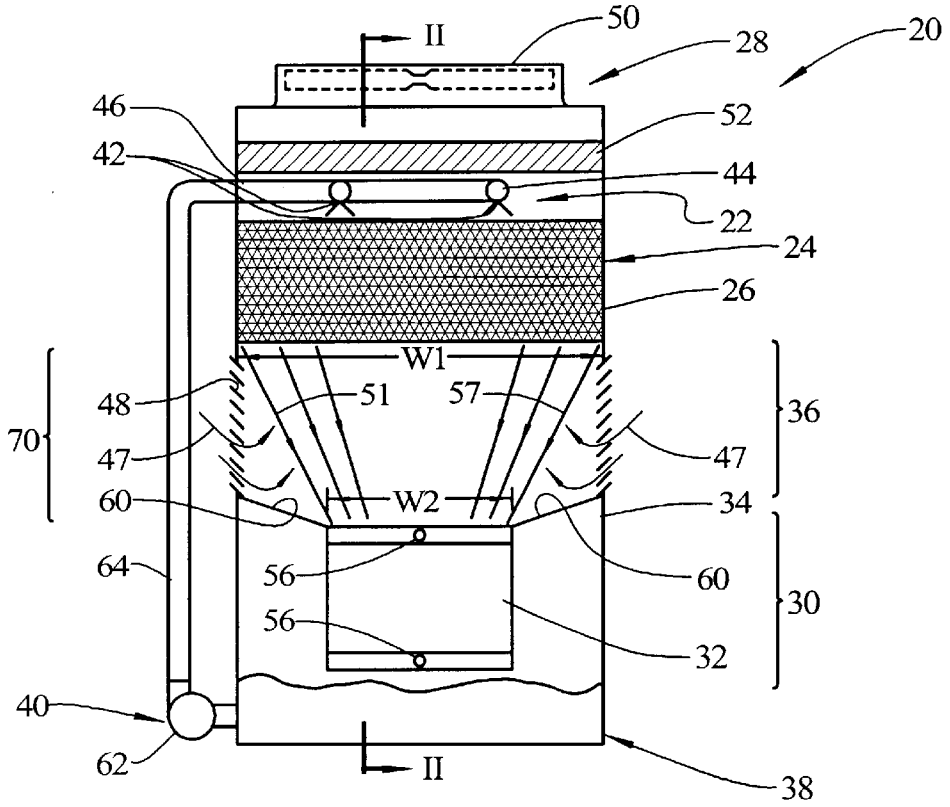
FIG. 1 is a side sectional view of an induced draft counter flow evaporative cooler embodying the principles of the present invention.
Figure 2:
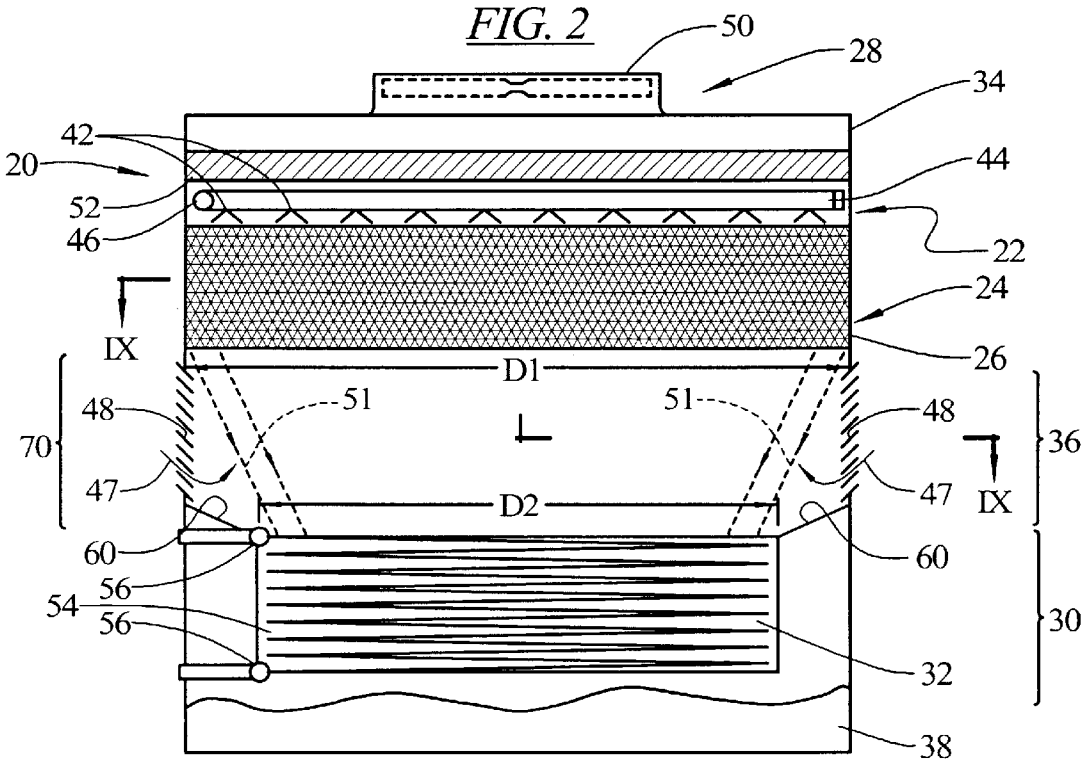
FIG. 2 is a schematic side sectional view of the induced draft counter flow evaporative cooler, rotated 90° and taken generally along line II—II of FIG. 1.

An evaporative cooler embodying the principles of the present invention is shown generally at 20 in FIGS. 1 and 2 and comprises several component parts. There is a liquid distributor shown generally at 22 and a direct heat transfer section at 24 which includes a body 26 with a surface for receiving liquid from the liquid distributor 22. An air moving device 28 is provided to generate a flow of air over the surface of the body 26 causing a small portion of the liquid flowing thereover-to evaporate, thereby cooling the remaining portion. An indirect cooling section is provided at 30 and typically includes at least one, and preferably a plurality of heat transfer working fluid conduits 32 in the form of loops or coils.

The body 26 is schematically illustrated as comprising an element which has a large surface area with a plurality of air passageways extending therethrough. The body surface can take many different forms. In one form, the body could comprise a stack of spaced apart sheet materials, for example, with the sheets oriented vertically such that the evaporative liquid would be distributed onto the surface of sheets to flow downwardly, while air passages would be formed between the spaced sheets so as to allow a flow of air over the sheets as the liquid is flowing over the sheets. In a more specific and preferred embodiment, the sheet material could be non-planar so as to provide a series of convolutions to increase the surface area for the liquid to flow over, while still providing a plurality of air flow passageways through the body. The body could also comprise a series of spaced slats or even a series of spaced tubes. Persons skilled in the art recognize such body constructions by the term wet deck fill and hereinafter the body 26 may be referred to as the wet deck fill or simply fill. A particular type of wet deck fill which Applicants have found to be very efficient and effective is that disclosed and claimed in U.S. Pat. No. 5,124,087, the disclosure of which is incorporated herein by reference.

The indirect heat transfer section is schematically illustrated as comprising at least one heat transfer working fluid conduit 32 having a surface to receive the non-evaporated liquid from the body 26. This conduit may take several forms including a series of individual coils or tubes 54 connected by headers 56 to provide an array of tubes, increasing a surface area for engagement by the non-evaporated liquid. A specific type of coil arrangement is disclosed in U.S. Pat. No. 4,755,331 in which the tubes have elliptical cross sections, although circular cross sections as described in that patent may also be utilized, as well as other cross-sectional configurations. Further, the conduit may be in the form of a hollow plate with passages formed therein for the working fluid to flow through while presenting a surface area of the plate for the non-evaporated liquid to flow over in an indirect heat transfer relationship. A series of such plates could be utilized with the plates oriented vertically with appropriate connections and headers for distributing the working fluid through the plates. Hereinafter the heat transfer working fluid conduit 32 may be referred to more simply as the heat exchanger coil, heat transfer coil, or very simply coil.

In the embodiment illustrated in FIG. 1 and FIG. 2, the fill 26 occupies substantially the full width W1 and depth D1 of a housing 34 enclosing various of the components of the evaporative cooler 20. The heat transfer coil 32 occupies a width W2 and a depth D2, at least one of which is smaller than the corresponding width W1 and depth D1 occupied by the fill 26. Thus, the coil 32 has a smaller plan area than the fill 26.

In a preferred embodiment the plan area of the coil 32 (second plan area) is the range of about 20% to 90% of the plan area of the fill 26 (first plan area). In another preferred embodiment the second plan area is in the range of 25% to 80% of the first plan area. In another preferred embodiment the second plan area is in the range of 40% to 70% of the first plan area.

Figure 9:
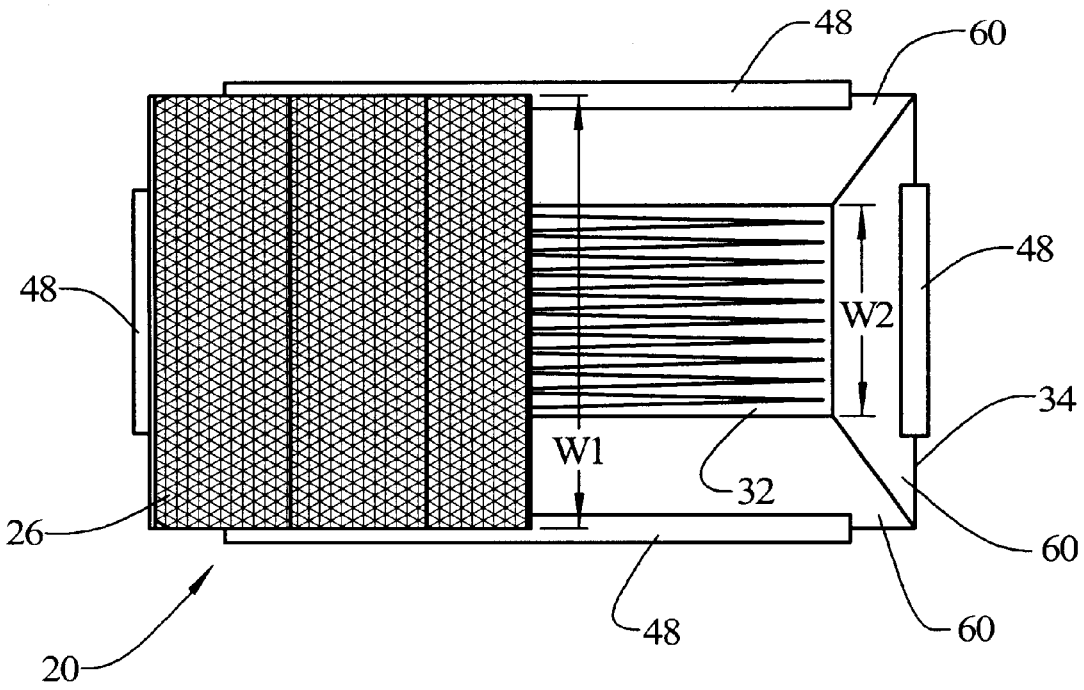
FIG. 9 is a sectional view taken generally along the line IX—IX of FIG. 2.

FIG. 9 illustrates a sectional view taken generally along the line IX—IX in FIG. 2, showing, from a top view, that the fill 26 occupies the width W1 which is the full width of the housing 34 and the heat transfer coil 32 occupies a lesser width W2 and is spaced away from each of the sidewalls of the housing. It can be seen that the plan area of the fill 26 shown in the left half of the FIG. is greater than the plan area of the heat transfer coil 32 (shown in the right half of the FIG.), and in fact about double in this illustration. In FIG. 2 positioned between the fill 26 and the heat transfer coil 32 is a liquid concentrator section 36 which concentrates the liquid leaving the fill 26 prior to its engagement with the heat transfer coil 32. A liquid collector 38 is positioned to collect liquid flowing from the surface of the heat transfer coil 32. A liquid recirculating mechanism 40 is provided to return the heated liquid from the liquid collector 38 to the liquid distributor 22.

In the embodiment illustrated in FIGS. 1 and 2, the liquid distributor comprises a series of individual nozzles 42 provided in liquid passageways 44 such as an array of pipes leading from a header pipe 46. It will be appreciated that a wide variety of liquid distributors could be utilized in addition to the embodiment schematically illustrated. For example, in lieu of having individual nozzles 42, the pipes 44 may merely be perforated. The liquid passageway may also be in the form of a single perforated pipe or perforated channels to which the liquid is introduced, with the liquid dripping from the pipe or channels through the perforations onto the fill 26. The passageways 44 may be in the form of closed pipes as illustrated, or may be in the form of open top channels or troughs. The precise arrangement of the liquid distributor is not critical, so long as it provides a relatively even distribution of liquid onto the fill 26 and allows for a flow of air to exit therethrough.

The air moving device 28 is shown in FIGS. 1 and 2 as a bladed fan positioned above the fill 26. A series of air inlet openings 48 are provided in the housing 34 below the wet deck fill 26 such that air is drawn into the housing 34 and over and through the fill 26 and to exit at a top of the housing through a large opening 50 positioned above the fan. In this arrangement, which is referred in the art to as an induced draft counterflow system, there is also typically provided a drift eliminator 52 to facilitate in removing entrained liquid droplets in the air stream prior to the air stream exiting the housing. Many different types and constructions of drift eliminators are known including closely spaced metal, plastic or wood slats or louvers which permit air flow therethrough, but which will collect fine water droplets in the air. In the arrangement illustrated, the collected water droplets will drop, under force of gravity, onto the wet deck fill 26 with the other distributed liquid.

Many other types of air moving devices will become apparent to those skilled in the art including blowers of various constructions, movable diaphragms, and even air moving devices with no moving parts, such as convection chimneys. The position of the air outlet opening 50 may vary and may be located in a sidewall rather than a top wall if space requirements warrant. Air can also be drawn downwardly over the wet deck fill 26 in a concurrent flow arrangement rather than the counter flow arrangement illustrated. Again, the precise construction and location for the air moving device is not critical, it being important only that the air is caused to flow over the surface of the fill 26 onto which the liquid is distributed. Persons of skill in the art will recognize that different types of air moving devices may be more suitable in certain situations depending on desired air flow rates, noise levels, space availability, etc.

The liquid leaving the wet deck 26 is cooled by the evaporative process, and in an efficient system, approaches the ambient wet bulb temperature of the air being drawn into the housing. The liquid progressively warms up as it falls through the heat transfer coil 32. In a preferred arrangement, the working fluid is introduced into the heat transfer coil 32 at a lower portion thereof and progresses upwardly therethrough to exit at a higher portion thereof so that the working fluid will cool as it moves upwardly and at the uppermost portion of the heat transfer coil, the working fluid will be the coolest, as will the liquid coming from the wet deck fill 26. Thus, the working fluid will be able to be cooled to a temperature approaching ambient wet bulb, the lowest temperature achievable by the evaporative cooler. If the working fluid is a gas to be condensed, it will have to flow from an upper end of the coil 32 to a lower end due to drainage requirements, even though such a flow direction is a bit less efficient for heat transfer considerations.

Other arrangements and constructions for the heat transfer coil 32 will be apparent to a person of skill in the art in that the precise construction is not critical, but rather it being important only that the conduit provide passage for the working fluid, provide a surface for engagement by the cooled liquid, and the material for the coil being such so as to permit a transfer of heat from the fluid to the liquid, but preventing passage of either the fluid or the liquid through the material.

The housing 34 is illustrated as being constructed of substantially vertical outer walls arranged generally perpendicular to one another so as to form a generally cubical shape. This particular shape, while convenient and economical to manufacture, is not necessary or critical to the invention, and the shape of the housing can vary widely, for example, the housing could have a circular cross section or other geometrical shape and, in fact, various components could be located in different housings, it not being critical that all of the elements be located in a single housing. (This will become more evident, especially with respect to the embodiment illustrated in FIG. 7 which is discussed below.)

A liquid concentrator section is illustrated at 36 and is comprised of two elements in the embodiment illustrated in FIGS. 1 and 2, even though one or the other or different elements could be used as the liquid concentrator. In the embodiment illustrated in FIGS. 1 and 2, the air inlets 48 provide a liquid concentrating function in that air is drawn in through the sidewalls of the housing 34 as shown at arrows 47 and up into and over the wet deck fill 26. As the air is drawn inwardly in a stream, liquid falling from the wet deck fill is impinged by the air stream and is caused to move inwardly under the influence of the air stream as shown by arrows 51, such that the water falling from the wet deck fill will concentrate toward the center of the housing, at least on those sides where there are air inlets 48.

Figure 10:
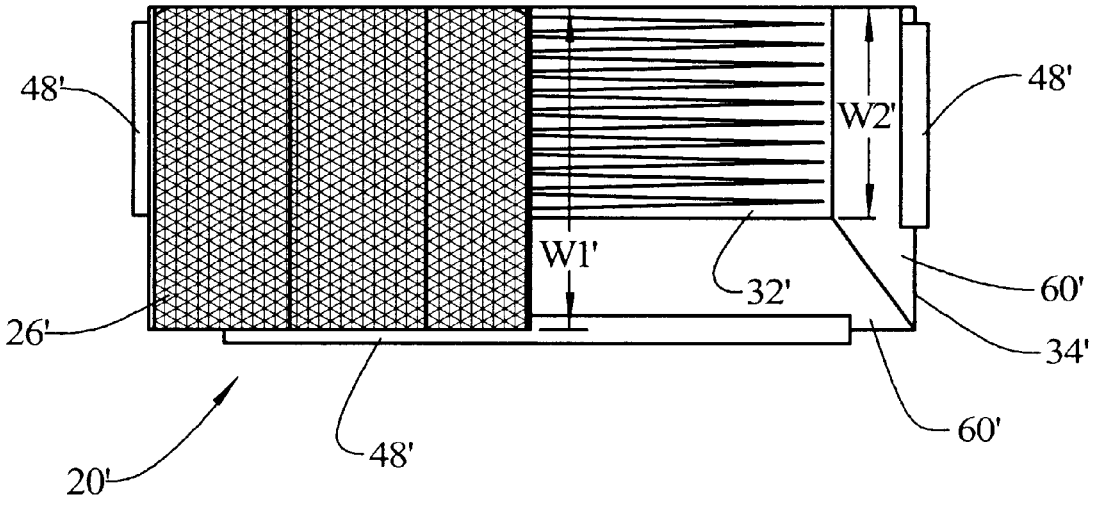
FIG. 10 is an alternative embodiment as if taken along the same line as for FIG. 9.

As schematically shown in FIG. 9, the heat transfer coil 32 may be spaced inwardly from each of the sidewalls of the housing 34, and air may be admitted through the inlets 48 in each of the sidewalls. However, in some applications, it may not be possible or feasible to admit air from all sides, and in such situations, it is possible to arrange the heat transfer coil 32 directly adjacent to a sidewall. This is shown in FIG. 10 where an evaporative cooler 20' includes a body 26' and a heat transfer coil 32' located in a housing 34', with air inlets 48' provided on only three sidewalls. While the wet deck fill 26' still occupies a full width W1' of the housing, and the heat transfer working coil 32' occupies a lesser width W2', the heat transfer coil is positioned directly adjacent to the sidewall without the air inlet. This may be done since there will be no air flow to provide a concentration of the falling liquid from the wet deck fill 26 along the wall without an air inlet 48. Of course, the number and location of the air inlets can be varied so that the air inlets are located in one or more sidewalls, and/or in a top wall if the air outlet opening 50 is moved to a sidewall as described above.

Another possible concentrating element illustrated in FIGS. 1, 2 and 9 is sloped walls 60 extending from the outer walls of the housing 34 and inwardly to a space occupied by the heat transfer coil 32. Thus, any liquid falling from the wet deck fill 26 which has not yet been concentrated into the smaller plan area occupied by the heat transfer coil 32 by the incoming air stream will be diverted by the sloped walls 60 toward the smaller plan area and, hence, concentrated. In FIG. 10, sloped walls 60' are also provided, and may be used as a sole arrangement for concentrating the liquid along a wall where there is no air inlet. Thus, in the arrangement illustrated in FIG. 10 although there is no air inlet 48' in the sidewall shown at the top of the figure, the heat transfer coil 32 could be spaced away from that wall, and a sloped wall 60' could have been used to provide the concentrating function at that location. Other structures and arrangements for concentrating the liquid moving from the first plan area occupied by the fill 26 to the second plan area occupied by the heat transfer coil 32 will be apparent to those skilled in the art. (One other specific arrangement is described with respect to FIG. 7.)

The liquid collector 38 in FIG. 10, is illustrated as a single open sump in the form of an open pan and a pipe located in the bottom of the housing although, again, different arrangements could be utilized including channels, passages, a closed tank or other arrangements for collecting the liquid. What is of importance is that the liquid be collected for recirculation to the liquid distributor 22.

For this purpose, the liquid recirculating mechanism 40 is provided which comprises an arrangement for moving the liquid collected in the liquid collector 38 to the liquid distributor 22. A variety of constructions could be utilized for the liquid recirculating mechanism 40 including a pump 62 with connected piping 64 leading from the liquid collector 38 up to the liquid distributor 22. The pump itself could be any of a variety of known pumps including displacement pumps, centrifugal pumps, peristaltic pumps, etc. Other arrangements for the liquid recirculating mechanism could also be utilized such as water wheels, rotating screws, a liquid conveyor such as with chains and buckets, and a variety of other constructions as would be apparent to a person of skill in the art, it being recognized that the liquid recirculating mechanism should be effective for moving liquid from the liquid collector 38 to the liquid distributor 22.

In the embodiment illustrated in FIGS. 1 and 2, the heat transfer working coil 32 is positioned substantially outside of the flow of air through the housing. That is, the air flows in through air inlets 48 and up through the wet deck fill 26 to pass through the drift eliminator 52 and past the air moving device 28 to exit through the opening 50. Applicants have determined that the evaporative efficiency of modem wet deck fill is substantially greater than the evaporative efficiency of typical coils used for heat transfer working fluid conduits. Therefore, the added energy required to draw additional air through the coils of the heat transfer working fluid conduit due to requirements for either a greater air flow, or an increased pressure drop, results in a less efficient evaporative cooler than if the heat transfer coil 32 is positioned substantially outside of the flow of air through the evaporative cooler.

As shown in the embodiment of FIGS. 1 and 2 there is the potential for air to move over the top surfaces of the coil as it moves from the air inlet areas inward and upward to the wet deck fill. There is even some potential for some portion of air to leak (or flow) inward in and around the lower housing walls, below the angled walls 60. Although it is not critical that there be no air flow over the heat transfer coil 32, in a preferred arrangement, the coil will be substantially, if not completely, outside of the air flow in order to increase the efficiency of the evaporative cooler.

The air inlets 48 are shown schematically as a series of louvers pointed downwardly so that air is caused to flow into the housing first downwardly before turning and flowing upwardly toward the body 26. Other configurations for the air inlets are known including straight, chevron, or serpentine passages. The air inlets 48 may be provided in each of the vertical walls of the housing, or less than all of the walls (as shown in FIG. 10), or throughout less than the entire circumference of the housing.

The arrangement illustrated in FIGS. 1 and 2 also includes a flow accelerator 70 positioned between the wet deck fill 26 and the heat transfer coil 32 to increase a flow velocity of the falling liquid before that liquid contacts a surface of the heat transfer coil. In the embodiment illustrated in FIGS. 1 and 2, this flow accelerator comprises a vertical spacing of a sufficient magnitude to permit a significant acceleration of the liquid falling from the wet deck fill 26 onto the heat transfer coil 32. Preferably a distance of approximately 2 feet (0.61 meters) and up to as much as 6 feet (1.8 meters) or more will provide an increase in the velocity of the liquid leaving the fill 126 of at least 9.5 feet per second (2.9 meters per second) and up to 15 feet per second (4.6 meters per second) or more.

Figure 3:
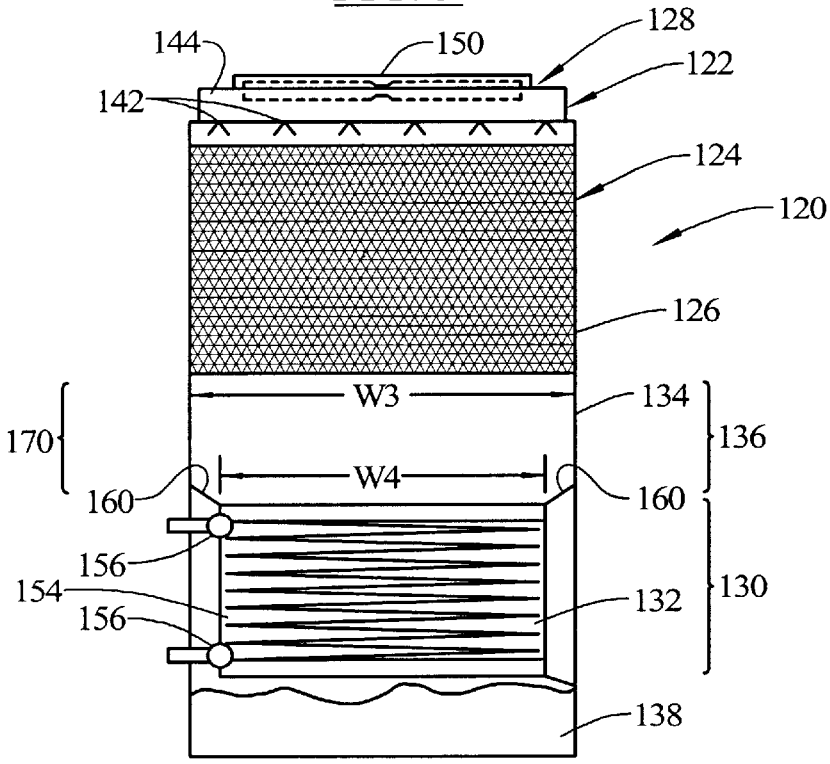
FIG. 3 is a schematic side sectional view of an induced draft cross-flow evaporative cooler embodying the principles of the present invention and taken generally along line III—III of FIG. 4.
Figure 4:
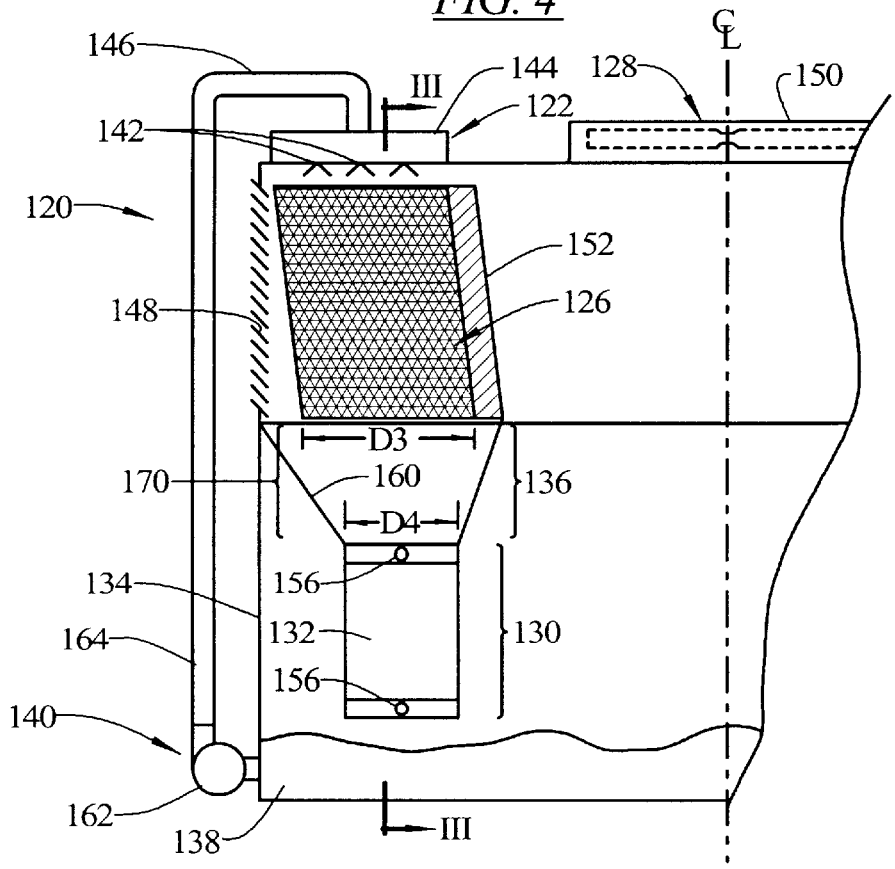
FIG. 4 is a schematic partial side sectional view of an induced draft cross-flow cooling tower taken at 90° from the view of FIG. 3.

Another embodiment of an evaporative cooler embodying the principles of the present invention is shown schematically at 120 in FIGS. 3 and 4 and comprises several component parts similar to these described above. Where elements are substantially identical as those described above, a similar 100 series reference numeral is used to designate the element and the description of the element and its function, if not specifically described below, is substantially as described above with respect to that element.

There is a liquid distributor shown generally at 122 and a direct heat transfer section at 124 which may include two spaced apart bodies (wet deck fill or simply fill) 126 each with a surface for receiving liquid from the liquid distributor 122. In FIG. 4 only the left fill 126 is shown, but a typical arrangement could include a second identical fill on the right. Additional fill could be provided on the two remaining opposing sides, so, in a four sided housing, 1 to 4 fill bodies could be provided as the application warrants.

An air moving device 128 is provided as described above. An indirect cooling section is provided at 130 and typically includes at least one, and preferably a plurality of heat transfer working fluid conduits 132 in the form of loops or coils in one or a plurality of spaced locations corresponding to the number of bodies.

In the embodiment illustrated in FIGS. 3 and 4, the fill 126 occupies substantially the full width W3 and a portion of a depth D3 of a housing 134 enclosing various components of the evaporative cooler 120. The heat transfer coil 132 occupies a width W4 and a depth D4, at least one of which is smaller than the corresponding width W3 and depth D3 occupied by the corresponding fill 126. Thus, the heat transfer coil 132 has a smaller plan area than the fill 126.

As described above, the plan area of the heat transfer coil 132 (second plan area) may be in the range of about 20% to 90% of the plan area of the body (first plan area), about 25% to 80% of the first plan area or about 40% to 70% of the first plan area. Positioned between each fill 126 and an associated heat transfer coil 132 is a liquid concentrator section 136. A liquid collector 138 is positioned to collect liquid flowing from the surface of the heat transfer coil 132. A liquid recirculating mechanism 140 is provided to return the heated liquid from the liquid collector 138 to the liquid distributor 122.

The air moving device 128 is shown in FIGS. 3 and 4 as a bladed fan positioned above the fill 126. A series of air inlet openings 148 are provided in the housing 134 adjacent to the fill 126 such that air is drawn into the housing 134 and over and through the fill 126 in a cross-flow arrangement, substantially perpendicular to the flow of evaporative liquid over the surface of the fill 126, and to exit at a top of the housing through a large opening 150 positioned above the fan. In this arrangement, which is referred in the art to as an induced draft cross-flow system, there is also typically provided a drift eliminator 152 as described above. In the arrangement illustrated, the collected water droplets will drop, under force of gravity, to the liquid concentrator section 136 with the other non-evaporated liquid.

Many other types of air moving devices and their locations will become apparent to those skilled in the art as described previously. Again, the precise construction and location for the air moving device is not critical, it being important only that the air is caused to flow over the surface of the fill 126 onto which the liquid is distributed.

The indirect heat transfer section 130 is schematically illustrated as comprising at least one heat transfer coil 132 having a surface to receive the cooled liquid from the fill 126. In a cross-flow arrangement as illustrated in FIGS. 3 and 4, typically two fill bodies 126 and two indirect heat transfer sections 130 are provided, although a single one of each could be provided, as could more than two. The heat transfer coil 132 may take several forms as described above.

A liquid concentrator section is illustrated at 136 and is comprised, in this embodiment, of a single element comprising sloped walls 160 extending from the outer walls of the housing 134 and inwardly to a space occupied by the heat transfer coil 132. Thus, any liquid falling from the fill 126 will be diverted by the sloped walls 160 toward the smaller plan area and, hence, concentrated. Other structures and arrangements for concentrating the liquid moving from the first plan area occupied by the body to the second, smaller plan area occupied by the heat transfer working fluid conduit will be apparent to those skilled in the art in addition to those previously described.

In the embodiment illustrated in FIGS. 3 and 4, the heat transfer coil 132 is positioned substantially outside of the flow of air through the housing. That is, the air flows in through air inlets 148 and across through the body 126 to pass through the drift eliminator 152 and past the air moving device 128 to exit through the opening 150.

The arrangement illustrated in FIGS. 3 and 4 also includes a flow accelerator 170 positioned between the fill 126 and the heat transfer coil 132 to accelerate a flow velocity of the non-evaporated liquid before that liquid contacts a surface of the heat transfer coil as described above.

In this embodiment, again, the heat transfer coefficient U-value can be increased in at least one of two ways, by providing a higher liquid load at the indirect heat transfer section 130 than at the direct heat transfer section 124 by concentration of the liquid between the two sections, and by increasing the velocity of liquid flow through the indirect heat transfer section.

Figure 5:
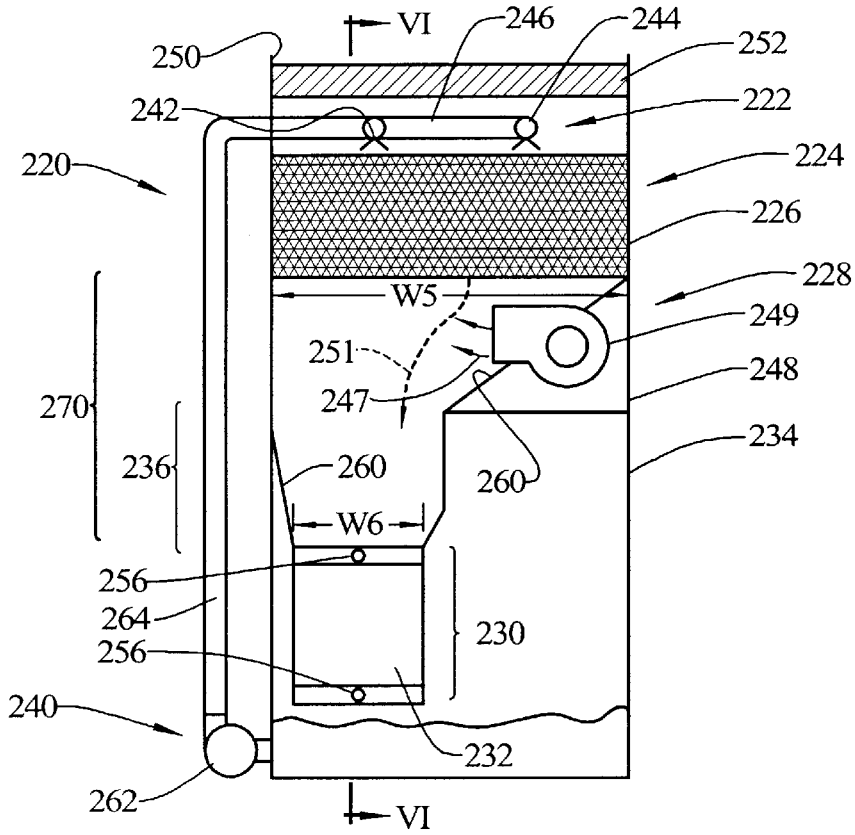
FIG. 5 is a schematic side sectional view of a forced draft counter flow evaporative cooler embodying the principles of the present invention.
Figure 6:
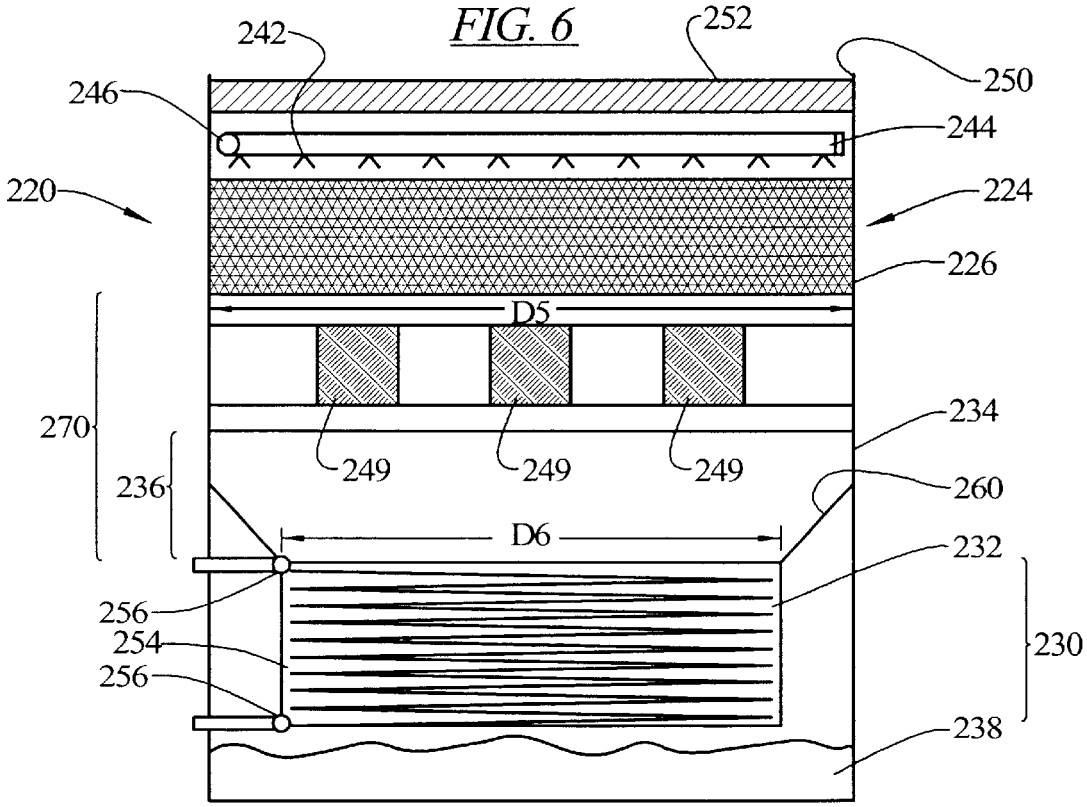
FIG. 6 is a schematic side sectional view of the forced draft counter flow evaporative cooler, rotated 90° and taken generally along the line VI—VI of FIG. 5.

Another embodiment of an evaporative cooler embodying the principles of the present invention is shown schematically at 220 in FIGS. 5 and 6 and comprises several component parts similar to these described above. Where elements are substantially identical as those described above, a similar 200 series reference numeral is used to designate the element and the description of the element and its function if not specifically described below, is substantially as described above with respect to that element.

There is a liquid distributor shown generally at 222 and a direct heat transfer section at 224 which includes a body (wet deck fill or simply fill) 226 with a surface for receiving liquid from the liquid distributor 222.

An air moving device 228 is provided as described above. An indirect cooling section is provided at 230 and typically includes at least one, and preferably a plurality of heat transfer working fluid conduits 232 in the form of loops or coils.

In the embodiment illustrated in FIGS. 5 and 6, the fill 226 occupies substantially the full width W5 and depth D5 of a housing 234 enclosing various of the components of the evaporative cooler 220. The heat transfer coil 232 occupies a width W6 and a depth D6, at least one of which is smaller than the corresponding width W5 and depth D5 occupied by the fill 226. Thus, the heat transfer working fluid conduit 232 has a smaller plan area than the fill 226.

As described above, the plan area of the heat transfer coil 232 (second plan area) may be in the range of about 20% to 90% of the plan area of the fill (first plan area), or about 25% to 80% of the first plan area, or about 40% to 70% of the first plan area. Positioned between the fill 226 and the heat transfer coil 232 is a liquid concentrator section 236 which concentrates the liquid leaving the fill 226 prior to engagement with the heat transfer coil 232. A liquid collector 238 is positioned to collect liquid flowing from the surface of the heat transfer coil 232. A liquid recirculating mechanism 40 is provided to return the heated liquid from the liquid collector 238 to the liquid distributor 222.

The air moving device 228 is shown in FIGS. 5 and 6 as three blowers 249 positioned below the body 226. Three air inlet openings 248 are provided in the housing 234 below the fill 226 such that air is drawn into the housing 234 and over and through the fill 226 to exit at a top of the housing through a large opening 250 positioned above the blower. In this arrangement, which is referred in the art to as a forced draft counterflow system, there is also typically provided a drift eliminator 252. In the arrangement illustrated, the collected water droplets will drop, under force of gravity, onto the body 226 with the other distributed liquid.

Many other types of air moving devices and their locations will become apparent to those skilled in the art as described previously. Again, the precise construction and location for the air moving device is not critical, it being important only that the air is caused to flow over the surface of the fill 226 onto which the liquid is distributed.

The indirect heat transfer section 230 is schematically illustrated as comprising at least one heat transfer coil 232 having a surface to receive the cooled liquid from the fill 226. This conduit may take several forms as described above.

A liquid concentrator section is illustrated at 236 and is comprised, in this embodiment, of a single element comprising sloped walls 260 extending from the outer walls of the housing 234 and inwardly to a space occupied by the heat transfer coil 232. Thus, any liquid falling from the fill 226 will be diverted by the sloped walls 260 toward the smaller plan area and, hence, concentrated. Other structures and arrangements for concentrating the liquid moving from the first plan area occupied by the fill to the second, smaller plan area occupied by the heat transfer coil will be apparent to those skilled in the art in addition to those previously described.

The arrangement illustrated in FIGS. 5 and 6 also includes a flow accelerator 270 positioned between the body 226 and the heat transfer working fluid conduit 232 to accelerate a flow velocity of the cooled liquid before that liquid contacts a surface of the heat transfer coil as described above.

In this embodiment, again, the heat transfer coefficient U-value can be increased in at least one of two ways, by providing a higher liquid load at the indirect heat transfer section 230 than at the direct heat transfer section 224 by concentration of the liquid between the two sections, and by increasing the velocity of liquid flow through the indirect heat transfer section.

Figure 7:
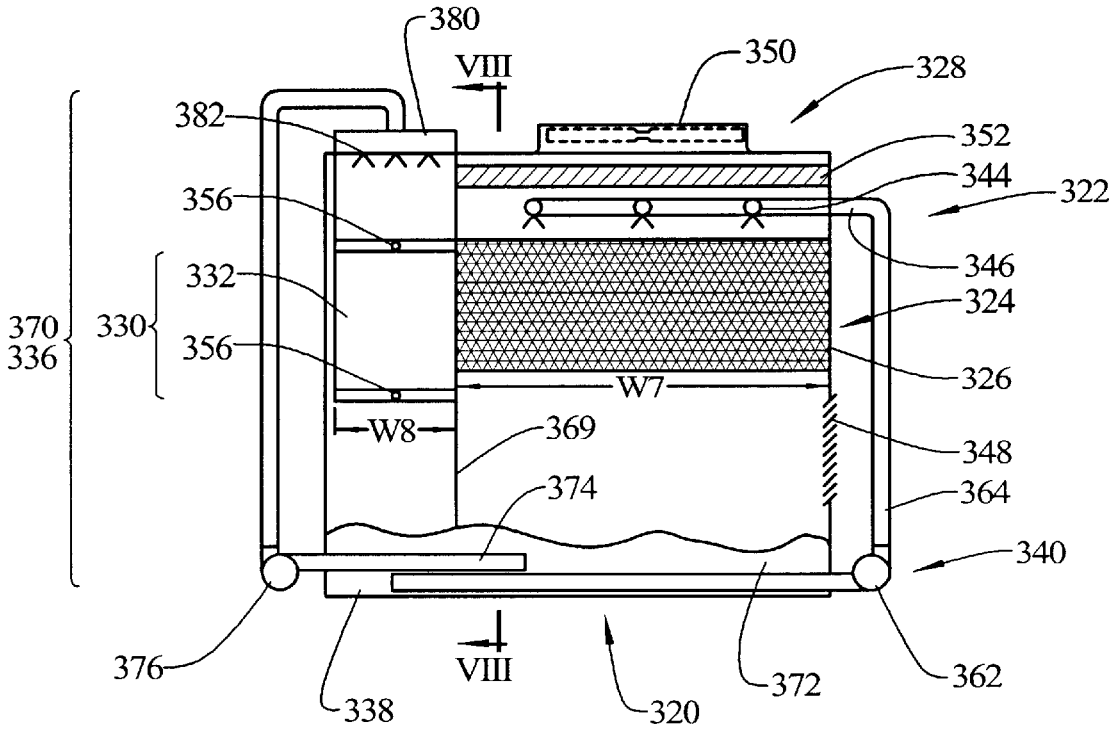
FIG. 7 is a schematic side sectional view of a side-by-side arrangement of an induced draft evaporative cooler embodying the principles of the present invention.
Figure 8:
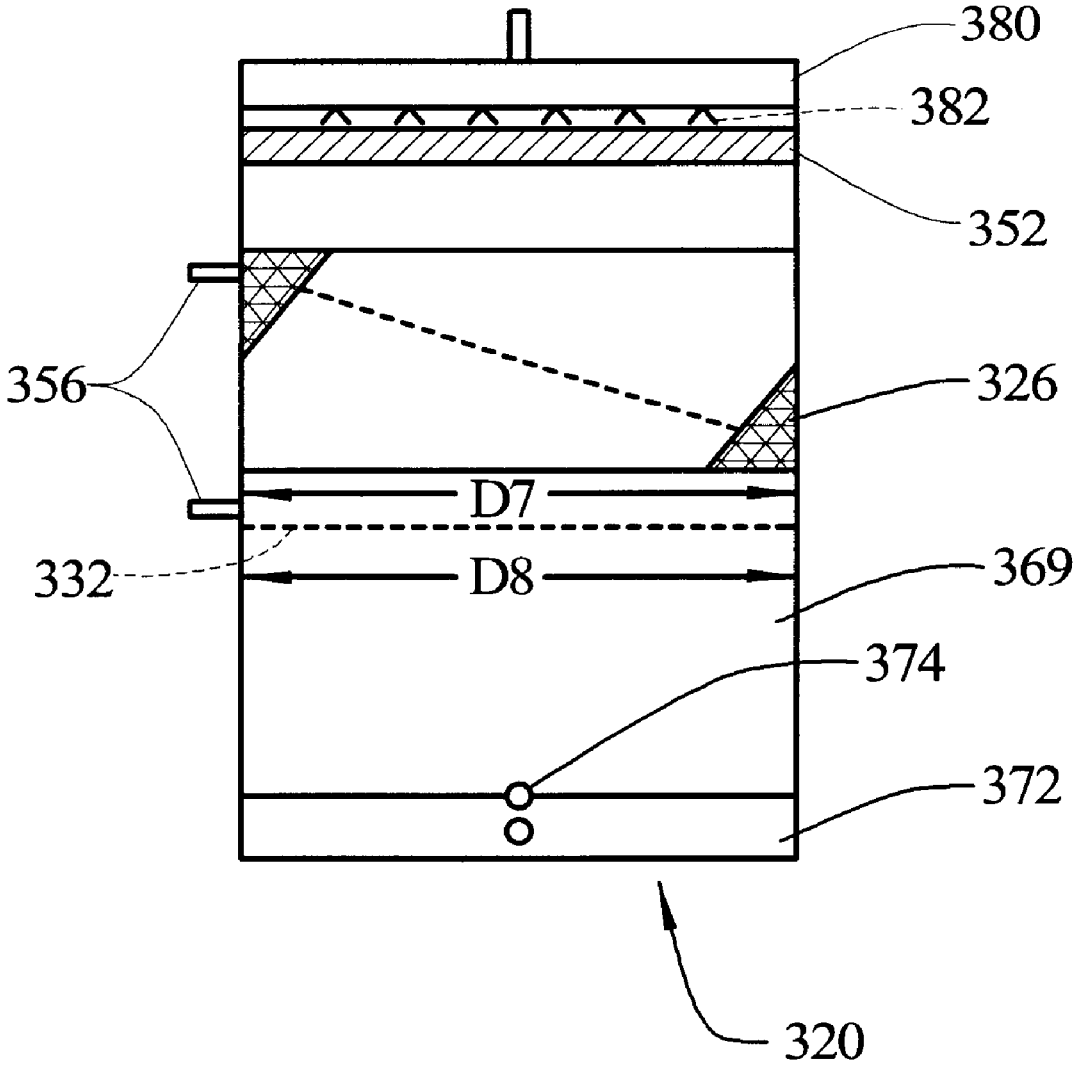
FIG. 8 is a sectional view taken generally along the line VIII—VIII of FIG. 7.

Another embodiment of an evaporative cooler embodying the principles of the present invention is shown schematically at 320 in FIGS. 7 and 8 and comprises several component parts similar to these described above. Where elements are substantially identical as those described above, a similar 300 series reference numeral is used to designate the element and the description of the element and its function if not specifically described below, is substantially as described above with respect to that element.

There is a liquid distributor shown generally at 322 and a direct heat transfer section at 324 which includes a body (wet deck fill or simply fill) 326 with a surface for receiving liquid from the liquid distributor 322.

In the embodiment illustrated in FIGS. 7 and 8, the fill 326 occupies substantially the full width W7 and depth D7 of a housing 334 enclosing various components of the evaporative cooler 320. The heat transfer coil 332 occupies a width W8 and a depth D8, at least one of which is smaller than the corresponding width W7 and depth D7 occupied by the fill 326. Thus, the heat transfer coil 332 has a smaller plan area than the fill 326. As described above, the plan area of the heat transfer working fluid conduit 332 (second plan area) may be in the range of about 20% to 90% of the plan area of the fill (first plan area), 25% to 80% of the first plan area, or about 40% to 70% of the first plan area. Positioned between the fill 326 and the heat transfer coil 332 is a liquid concentrator section 336. A liquid collector 338 is positioned to collect warmed liquid flowing from the surface of the heat transfer coil 332. A liquid recirculating mechanism 340 is provided to return the warmed liquid from the liquid collector 338 to the liquid distributor 322.

An air moving device 328 is shown in FIG. 7 as a bladed fan positioned above the fill 326. A series of air inlet openings 348 are provided in the housing 334 below the fill 326 such that air is drawn into the housing 334 and over and through the fill 326 and to exit at a top of the housing through a large opening 350 positioned above the fan. In this arrangement, which is referred in the art to as a side-by-side arrangement of an induced draft counterflow system, there is also typically provided a drift eliminator 352. In the arrangement illustrated, the collected water droplets will drop, under force of gravity, onto the fill 326 with the other distributed liquid.

Many other types of air moving devices and their locations will become apparent to those skilled in the art as described previously. Again, the precise construction and location for the air moving device is not critical, it being important only that the air is caused to flow over the surface of the fill 326 onto which the liquid is distributed.

The indirect heat transfer section 330 is schematically illustrated as comprising at least one heat transfer coil 332 having a surface to receive the cooled liquid from the fill 326. The flow of fluid through the coil 332 could be arranged as previously described.

In this embodiment, the direct heat transfer section 324 is located in one housing part and the indirect cooling section 330 is located in a separate housing part, separated by a wall 369 which, although illustrated as a common wall between the two housing parts, need not be common, and the two housing parts could be located at a distance from one another and at different elevations.

A liquid concentrator section is illustrated at 336 and is comprised of a liquid collecting area 372 for cooled liquid falling from the fill 326. This liquid is drawn into a pipe 374 extending through the wall 369, through a pump 376, up another pipe 378 and into a liquid distributor 380 which has nozzles or openings 382 for causing the liquid to leave the distributor 380. The nozzles or openings 382 may be spaced above the heat transfer working fluid conduit by a sufficient amount to permit the liquid to accelerate under the influence of gravity to a desired velocity as described previously. The liquid may also be sprayed out of the nozzles or openings 382 under sufficient pressure to also increase the velocity of the liquid a desired amount, such as up to 9.5 feet per second (2.9 meters per second) or more. Preferably an interconnector or liquid flow path exists between the liquid collecting area 372 for the cooled liquid from the fill 326 and the liquid collector 338 so that any variation in flow rates out of the collecting area 372 and the liquid collector 338 can be equalized. Since it is difficult to operate both pumps at precisely the same speed, it is preferable to operate the recirculating pump at a slightly higher rate so that the cooled liquid from the fill 326 will flow over into the liquid collector 338 to mix with the warmer liquid falling from the heat transfer coil surface.

In the embodiment illustrated in FIGS. 7 and 8, the heat transfer coil 332 is positioned substantially outside of the flow of air through the housing. That is, the air flows in through air inlets 348 and up through the fill 326 to pass through the drift eliminator 352 and past the air moving device 328 to exit through the opening 350.

The arrangement illustrated in FIGS. 7 and 8 also includes a flow accelerator 370 positioned between the fill 326 and the heat transfer coil 332 to accelerate a flow velocity of the non-evaporated liquid before that liquid contacts a surface of the heat transfer coil as described above. Here the flow accelerator 370 may comprise the pump 376, piping 374, and nozzles 382 and/or the distance between the nozzles 382 and the coil 332.

In this embodiment, again, the heat transfer coefficient U-value can be increased in at least one of two ways, by providing a higher liquid load at the indirect heat transfer section 330 than at the direct heat transfer section 324 by concentration of the liquid between the two sections, and by increasing the velocity of liquid flow through the indirect heat transfer section.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An evaporative cooler comprising:

a liquid distributor;

a body having a surface and occupying a first plan area for receiving liquid from said liquid distributor over said surface substantially throughout said first plan area; an air moving device arranged to generate a flow of air;

said body surface being positioned in said flow of air and said flow of air causing a small portion of said liquid received by said body to evaporate, thereby cooling a remaining portion;

a heat transfer working fluid conduit positioned substantially outside of said flow of air and having a second plan area dimensioned smaller than said first plan area;

said heat transfer working fluid conduit having a surface arranged to receive substantially all of the cooled liquid portion from said body thereover in a heat transfer relationship to warm said liquid portion;

a flow accelerator positioned between said body and said heat transfer working fluid conduit to accelerate a flow velocity of said non-evaporated liquid by at least 9.5 feet/second (2.9 meters/second) before contacting said heat transfer working fluid conduit, a liquid concentrator arranged between said body and said heat transfer working fluid conduit to concentrate said non-evaporated liquid from said first plan area, substantially into said second plan area;

a liquid collector arranged to receive substantially all of the warmed liquid portion from said heat transfer working fluid conduit;

a liquid recirculating mechanism arranged to return said warmed liquid portion to said liquid distributor.

2. An evaporative cooler according to claim 1, wherein said liquid collector comprises an open pan.

3. An evaporative cooler according to claim 1, wherein said liquid collector comprises a pipe.

4. An evaporative cooler according to claim 1, wherein said liquid recirculating mechanism comprises a pump.

5. An evaporative cooler according to claim 1, wherein said liquid distributor comprises at least one nozzle.

6. An evaporative cooler according to claim 1, wherein said liquid distributor comprises a perforated liquid passageway.

7. An evaporative cooler according to claim 1, wherein said body comprises a wet deck fill.

8. An evaporative cooler according to claim 1, wherein said body comprises a stack of vertically oriented sheet materials.

9. An evaporative cooler according to claim 8, wherein said sheet materials are non-planar.

10. An evaporative cooler according to claim 1, wherein said air moving device comprises a fan.

11. An evaporative cooler according to claim 1, wherein said air moving device comprises a blower.

12. An evaporative cooler according to claim 1, wherein said heat transfer working fluid conduit comprises at least one pipe coil.

13. An evaporative cooler according to claim 1, wherein said heat transfer working fluid conduit is positioned completely outside of said flow of air.

14. An evaporative cooler according to claim 1, wherein said heat transfer working fluid conduit is positioned vertically below said body.

15. An evaporative cooler according to claim 1, wherein said heat transfer working fluid conduit is positioned laterally from said body.

16. An evaporative cooler according to claim 1, wherein said liquid concentrator comprises angled walls extending in a space between said body and said heat transfer working fluid conduit.

17. An evaporative cooler according to claim 1, wherein said liquid concentrator comprises a liquid collector arranged to receive substantially all of the non-evaporated liquid from said body and a liquid distributor arranged to dispense substantially all of the non-evaporated liquid onto said heat transfer working fluid conduit at substantially the same rate as it is received from said body.

18. An evaporative cooler according to claim 1, wherein said air moving device is arranged to generate said flow of air over said surface of said body in a direction counter to a direction of a flow of said liquid over said surface of said body.

19. An evaporative cooler according to claim 1, wherein said air moving device is arranged to generate said flow of air over said surface of said body in a direction substantially perpendicular to a direction of a flow of said liquid over said surface of said body.

20. An evaporative cooler according to claim 1, wherein said second plan area is in the range of about 20% to 90% of said first plan area.

21. An evaporative cooler according to claim 1, wherein said second plan area is in the range of about 25% to 80% of said first plan area.

22. An evaporative cooler according to claim 1, wherein said second plan area is in the range of about 40% to 70% of said first plan area.

23. An evaporative cooler according to claim 1, wherein said heat transfer working fluid conduit comprises a coil assembly with an inlet positioned below an outlet such that a liquid working fluid can be directed into said inlet to flow upwardly through said coil assembly, exchanging heat energy through walls of said coil assembly with said cooled liquid portion flowing downwardly thereover to cool said liquid working fluid, and said liquid working fluid will exit said coil through said outlet.

24. An evaporative cooler according to claim 1, wherein said heat transfer working fluid conduit comprises a coil assembly with an inlet positioned above an outlet such that a gaseous working fluid can be directed into said inlet to flow downwardly through said coil assembly, exchanging heat energy through walls of said coil assembly with said cooled liquid portion flowing downwardly thereover to condense said gaseous working fluid to a liquid, and said working fluid will exit said coil through said outlet.

25. An evaporative cooler according to claim 1, wherein said flow accelerator comprises a vertical space between said heat transfer working fluid conduit and said body of at least 24 inches (0.61 meters).

26. An evaporative cooler according to claim 1, wherein said liquid concentrator comprises a vertical space between said heat transfer working fluid conduit and air inlets for said air moving device arranged in said space between said body and said heat transfer working fluid conduit, such that an air stream from said air inlets to said air moving device will concentrate said non-evaporated liquid from said first plan area substantially into said second plan area as said non-evaporated liquid falls between said body and said heat transfer working fluid conduit.

27. An evaporative cooler comprising:

a liquid distributor;

a body having a surface for receiving liquid from said liquid distributor;

an air moving device arranged to generate a flow of air over said body surface, said flow of air causing a small portion of said liquid received by said body to evaporate thereby cooling a remaining portion;

a heat transfer working fluid conduit arranged to receive substantially all of the cooled liquid portion from said body in a heat transfer relationship to warm said remaining portion; a flow accelerator positioned between said body and said heat transfer working fluid conduit to accelerate a flow velocity of said cooled liquid portion by at least 9.5 feet per second (2.9 meters per second) before contacting a surface of said heat transfer working fluid conduit;

a liquid collector positioned to receive substantially all of the warmed liquid portion from said surface of said heat transfer working fluid conduit;

a liquid recirculating mechanism; and liquid passageways connecting said liquid reservoir, said recirculating mechanism and said liquid distributor.

28. An evaporative cooler according to claim 27, wherein said flow accelerator comprises an open plenum positioned between said body and said heat transfer working fluid conduit.

29. An evaporative cooler according to claim 27, wherein said flow accelerator comprises a pump and spray nozzle system.

30. An evaporative cooler according to claim 27, wherein said heat transfer working fluid conduit is positioned substantially outside of said flow of air.

31. An evaporative cooler according to claim 27, wherein said body has a surface and occupies a first plan area for receiving liquid from said liquid distributor over said surface substantially throughout said first plan area, said heat transfer working fluid conduit has a second plan area dimensioned smaller than said first plan area and including a liquid concentrator arranged between said body and said heat transfer working fluid conduit to concentrate said non-evaporated liquid from said first plan area into said second plan area.

32. An evaporative cooler comprising:

a liquid distributor;

a body for receiving liquid from said liquid distributor;

an air moving device arranged to generate a flow of air across said body, said flow of air causing a small portion of said liquid received by said body to evaporate thereby cooling a remaining portion;

a heat transfer working fluid conduit arranged in a downwardly spaced position relative to said body to cause said cooled liquid portion leaving from said body to accelerate under the force of gravity by at least 9.5 feet/second (2.9 meters/second) before contacting a surface of said heat transfer working fluid conduit;

a liquid collector positioned to receive substantially all liquid from said surface of said heat transfer working fluid conduit;

a liquid recirculating mechanism; and liquid conduits connecting said liquid reservoir, said recirculating mechanism and said liquid distributor.

33. An evaporative cooler according to claim 32, wherein said heat transfer working fluid conduit is positioned substantially out of said flow of air.

34. An evaporative cooler according to claim 32, wherein said body has a surface and occupies a first plan area for receiving liquid from said liquid distributor over said surface substantially throughout said first plan area, said heat transfer working fluid conduit has a second plan area dimensioned smaller than said first plan area and including a liquid concentrator arranged between said body and said heat transfer working fluid conduit to concentrate said cooled liquid portion from said first plan area into said second plan area.

35. A method of cooling a working fluid comprising the steps of:

dispensing a liquid onto a surface of a body;

flowing air over said body surface to effect an evaporation of a small portion of said liquid thereby cooling a remaining portion;

accelerating said cooled portion of said liquid to a velocity of at least 9.5 feet per second (2.9 meters per second) and directing said liquid onto a surface of a heat transfer working fluid conduit;

flowing the working fluid through said heat transfer working fluid conduit to transfer heat from said working fluid to said cooled portion of said liquid to warm said portion;

collecting said warmed liquid portion from said exterior surface of said heat transfer working fluid conduit and recirculating said warmed liquid portion onto said body.

36. A method according to claim 35, wherein said heat transfer working fluid conduit is maintained in an area substantially free of an air flow.

37. An evaporative cooler comprising:

a liquid distributor;

a body having a surface and occupying a first plan area for receiving liquid from said liquid distributor over said surface substantially throughout said first plan area;

an air moving device arranged to generate a flow of air;

said body surface being positioned in said flow of air and said flow of air causing a small portion of said liquid received by said body to evaporate, thereby cooling a remaining portion;

a heat transfer working fluid conduit positioned substantially outside of said flow of air and having a second plan area dimensioned smaller than said first plan area;

said heat transfer working fluid conduit having a surface arranged to receive substantially all of the cooled liquid portion from said body thereover in a heat transfer relationship to warm said liquid portion;

a liquid concentrator arranged between said body and said heat transfer working fluid plan area, said liquid concentrator comprising a vertical space between said heat transfer working fluid conduit and said body and air inlets for said air moving device arranged in said space between said body and said heat transfer working fluid conduit, such that an air stream from said air inlets to said air moving device will concentrate said non-evaporated liquid from said first plan area, substantially into said second plan area as said non-evaporated liquid falls between said body and said heat transfer working fluid conduit;

a liquid collector arranged to receive substantially all of the warmed liquid portion from said heat transfer working fluid conduit;

a liquid recirculating mechanism arranged to return said warmed liquid portion to said liquid distributor.

38. An evaporative cooler according to claim 37, including a flow accelerator positioned between said body and said heat transfer working fluid conduit to accelerate a flow velocity of said non-evaporated liquid by at least 9.5 feet/second (2.9 meters/second) before contacting said heat transfer working fluid conduit.

39. An evaporative cooler comprising:

a liquid distributor;

a body having a surface and comprising a stack of vertically oriented sheet materials, wherein said sheet materials are non-planer, and occupying a first plan area for receiving liquid from said liquid distributor over said surface substantially throughout said first plan area;

an air moving device arranged to generate a flow of air; said body surface being positioned in said flow of air and said flow of air causing a small portion of said liquid received by said body to evaporate, thereby cooling a remaining portion;

a heat transfer working fluid conduit positioned substantially outside of said flow of air and having a second plan area dimensioned smaller than said first plan area;

said heat transfer working fluid conduit having a surface arranged to receive substantially all of the cooled liquid portion from said body thereover in a heat transfer relationship to warm said liquid portion;

a flow accelerator positioned between said body and said heat transfer working fluid conduit to accelerate a flow velocity of said non-evaporated liquid;

a liquid concentrator arranged between said body and said heat transfer working fluid conduit, to concentrate said non-evaporated liquid from said first plan area, substantially into said second plan area;

a liquid collector arranged to receive substantially all of the warmed liquid portion from said heat transfer working fluid conduit;

a liquid recirculating mechanism arranged to return said warmed liquid portion to said liquid distributor.

40. An evaporative cooler according to claim 39, wherein said flow accelerator accelerates a flow velocity of said non-evaporated liquid by at least 9.5 feet/second (2.9 meters/second) before contacting said heat transfer working fluid conduit.

41. An evaporative cooler according to claim 40, wherein said flow accelerator comprises a vertical space between said heat transfer working fluid conduit and said body of at least 24 inches (0.61 meters).

42. An evaporative cooler according to claim 39, wherein said liquid concentrator comprises a vertical space between said heat transfer working fluid conduit and said body and air inlets for said air moving device arranged in said space between said body and said heat transfer working fluid conduit, such that an air stream from said air inlets to said air moving device will concentrate said non-evaporated liquid from said first plan area substantially to said second plan area as said non-evaporated liquid falls between said body and said heat transfer working fluid conduit.

43. An evaporative cooler comprising:

a liquid distributor;

a body having a surface and comprising a stack of vertically oriented sheet materials, wherein said sheet materials are non-planer, and occupying a first plan area for receiving liquid from said liquid distributor over said surface substantially throughout said first plan area;

an air moving device arranged to generate a flow of air;

said body surface being positioned in said flow of air and said flow of air causing a small portion of said liquid received by said body to evaporate, thereby cooling a remaining portion;

a heat transfer working fluid conduit positioned substantially outside of said flow of air and having a second plan area dimensioned smaller than said first plan area;

said heat transfer working fluid conduit having a surface arranged to receive substantially all of the cooled liquid portion from said body thereover in a heat transfer relationship to warm said liquid portion,;

a flow accelerator positioned between said body and said heat transfer working fluid conduit to accelerate a flow velocity of said non-evaporated liquid by at least 9.5 feet/second (2.9 meters/second) before contacting said heat transfer working fluid conduit a liquid concentrator arranged between said body and said heat transfer working fluid plan area, said liquid concentrator comprising a vertical space between said heat transfer working fluid conduit and air inlets for said air moving device arranged in said space between said body and said heat transfer working fluid conduit, such that an air stream from said air inlets to said air moving device will concentrate said non-evaporated liquid from said first plan area, substantially into said second plan area as said non-evaporated liquid falls between said body and said heat transfer working fluid conduit;

a liquid collector arranged to receive substantially all of the warmed liquid portion from said heat transfer working fluid conduit;

a liquid recirculating mechanism arranged to return said warmed liquid portion to said liquid distributor.

44. An evaporative cooler according to claim 43, wherein said flow accelerator comprises the vertical space between said heat transfer working fluid conduit and said body comprising at least 24 inches (0.61 meters).

45. An evaporative cooler comprising:

a liquid distributor;

a body having a surface and occupying a first plan area for receiving liquid from said liquid distributor over said surface substantially throughout said first plan area;

an air moving device arranged to generate a flow of air;

said body surface being positioned in said flow of air and said flow of air causing a small portion of said liquid received by said body to evaporate, thereby cooling a remaining portion;

a heat transfer working fluid conduit positioned vertically below said body and having a second plan area dimensioned smaller than said first plan area;

said heat transfer working fluid conduit having a surface arranged to receive substantially all of the cooled liquid portion from said body thereover in a heat transfer relationship to warm said liquid portion, a flow accelerator positioned between said body and said heat transfer working fluid conduit to accelerate a flow velocity of said non-evaporated liquid by at least 9.5 feet/second (2.9 meters/second) before contacting said heat transfer working fluid conduit, a liquid concentrator arranged between said body and said heat transfer working fluid conduit to concentrate said cooled liquid portion from said first plan area into said second plan area;

a liquid collector arranged to receive substantially all of the warmed liquid portion from said heat transfer working fluid conduit; and a liquid recirculating mechanism arranged to return said warmed liquid portion to said liquid distributor.

46. An evaporative cooler according to claim 45, wherein said heat transfer working fluid conduit is positioned substantially out of said flow of air.

47. An evaporative cooler comprising:

a liquid distributor;

a body having a surface and occupying a first plan area for receiving liquid from said liquid distributor over said surface substantially throughout said first plan area;

an air moving device arranged to generate a flow of air;

said body surface being positioned in said flow of air and said flow of air causing a small portion of said liquid received by said body to evaporate, thereby cooling a remaining portion;

a heat transfer working fluid conduit positioned vertically below said body and having a second plan area dimensioned smaller than said first plan area;

said heat transfer working fluid conduit having a surface arranged to receive substantially all of the cooled liquid portion from said body thereover in a heat transfer relationship to warm said liquid portion, a liquid concentrator arranged between said body and said heat transfer working fluid plan area, said liquid concentrator comprising a vertical space between said heat transfer working fluid conduit and said body and air inlets for said air moving device arranged in said space between said body and said heat transfer working fluid conduit, such that an air stream from said air inlets to said air moving device will concentrate said non-evaporated liquid from said first plan area, substantially into said second plan area as said non-evaporated liquid falls between said body and said heat transfer working fluid conduit;

a liquid collector arranged to receive substantially all of the warmed liquid portion from said heat transfer working fluid conduit; and a liquid recirculating mechanism arranged to return said warmed liquid portion to said liquid distributor.

48. An evaporative cooler according to claim 47, including a flow accelerator positioned between said body and said heat transfer working fluid conduit to accelerate a flow velocity of said cooled liquid portion by at least 9.5 feet/ second (2.9 meters/second) before contacting said heat transfer working fluid conduit.

49. A method of cooling a working fluid comprising the steps of:

dispensing a liquid onto a surface of a body wherein said body occupies a first plan area;

flowing air over said body surface to effect an evaporation of a small portion of said liquid thereby cooling a remaining portion;

dispensing and concentrating said cooled portion of said liquid onto a surface of a heat transfer working fluid conduit at a flow velocity accelerated by at least 9.5 feet/second (2.9 meters/second) from a flow velocity of said cooled portion of said liquid leaving said body surface, wherein said heat transfer working fluid conduit occupies a second plan area smaller than said first plan area;

flowing the working fluid through said heat transfer working fluid conduit to transfer heat from said working fluid to said cooled portion of said liquid to warm said portion;

collecting said warmed liquid portion from said exterior surface of said heat transfer working fluid conduit and recirculating said warmed liquid portion onto said body, said steps all occurring within a single housing of an evaporative cooler.

50. A method according to claim 49, wherein said heat transfer working fluid conduit is maintained in an area substantially free of an air flow.

51. A method of cooling a working fluid comprising the steps of:

dispensing a liquid onto a surface of a body wherein said body occupies a first plan area;

flowing air over said body surface to effect an evaporation of a small portion of said liquid thereby cooling a remaining portion;

dispensing and concentrating said cooled portion of said liquid onto a surface of a heat transfer working fluid conduit by dropping said cooled portion of said liquid through a vertical space between said heat transfer working fluid conduit and said body and by arranging air inlets for said air moving device in said space between said body and said heat transfer working fluid conduit, such that an air stream from said air inlets to said air moving device will concentrate said cooled portion of said liquid and wherein said heat transfer working fluid conduit occupies a second plan area smaller than said first plan area;

flowing the working fluid through said heat transfer working fluid conduit to transfer heat from said working fluid to said cooled portion of said liquid to warm said portion;

collecting said warmed liquid portion from said exterior surface of said heat transfer working fluid conduit and recirculating said warmed liquid portion onto said body, said steps all occurring within a single housing of an evaporative cooler.

52. A method according to claim 51, wherein a velocity of said cooled liquid portion is increased by at least 9.5 feet per second (2.9 meters per second) from when it leaves the surface of said body until it contacts said heat transfer working fluid conduit.

* * * * *